US009987541B2

(12) United States Patent
Traustason

(10) Patent No.: US 9,987,541 B2
(45) Date of Patent: Jun. 5, 2018

(54) METHOD AND APPARATUS FOR A USER-CONFIGURABLE ATHLETIC TRAINING APPARATUS

(71) Applicant: Gudmundur Orn Traustason, Deerfield Beach, FL (US)

(72) Inventor: Gudmundur Orn Traustason, Deerfield Beach, FL (US)

( * ) Notice: Subject to any disclaimer, the term of this patent is extended or adjusted under 35 U.S.C. 154(b) by 229 days.

(21) Appl. No.: 14/829,407

(22) Filed: Aug. 18, 2015

(65) Prior Publication Data

US 2016/0045800 A1 Feb. 18, 2016

Related U.S. Application Data

(60) Provisional application No. 62/038,433, filed on Aug. 18, 2014.

(51) Int. Cl.
*A63F 13/00* (2014.01)
*A63B 69/00* (2006.01)
(Continued)

(52) U.S. Cl.
CPC ..... *A63B 69/002* (2013.01); *A63B 69/00* (2013.01); *A63B 69/0053* (2013.01); *A63B 71/0622* (2013.01); *A63B 2024/004* (2013.01); *A63B 2071/0625* (2013.01); *A63B 2207/02* (2013.01); *A63B 2220/53* (2013.01); *A63B 2220/56* (2013.01); *A63B 2225/50* (2013.01)

(58) Field of Classification Search
CPC . A63B 69/002; A63B 69/005; A63B 71/0622; A63B 2024/004; A63B 2071/0625; A63B 2207/02; A63B 2220/53; A63B 2220/56; A63B 2225/50
See application file for complete search history.

(56) References Cited

U.S. PATENT DOCUMENTS 6,581,931 B1 6/2003 Doepner et al.
7,850,514 B2 12/2010 Weber
(Continued)

FOREIGN PATENT DOCUMENTS

WO 0018479 A1 4/2000
WO 2012162505 A1 11/2012
WO 2015063499 A1 5/2015

*Primary Examiner* — Tramar Harper
*Assistant Examiner* — Jeffrey Wong
(74) *Attorney, Agent, or Firm* — Gudmundur Orn Traustason; Brian Buchheit; Patents on Demand P.A.

(57) ABSTRACT

An athletic training system includes one or more panels that present a rigid front surface covered by a translucent material behind which is an illumination or light source and a pressure sensor that can detect and measure the pressure caused by impact of a ball (i.e. a soccer ball). A control device communicates with and controls the panels according to a selected exercise regimen that is designed to develop particular skills for an athletic or sporting endeavor by commanding the panel or panels to illuminate (i.e. turn on its light source). While illuminated, the panel actively monitors its pressure sensor for an indication of an impact, and upon detecting an impact, reports the detection of the impact to the control device, and turns off its illumination. The process of turning panels on and off and detecting impact can be used to construct various regimens for training and developing skills.

20 Claims, 10 Drawing Sheets

(51) Int. Cl.
*A63B 71/06* (2006.01)
*A63B 24/00* (2006.01)

(56) References Cited

U.S. PATENT DOCUMENTS

| | | | | |
|---|---|---|---|---|
| 2007/0191141 | A1 | 8/2007 | Weber | |
| 2009/0069123 | A1 | 3/2009 | Nugent | |
| 2010/0076347 | A1* | 3/2010 | McGrath | A61B 5/1038 600/595 |
| 2012/0021872 | A1* | 1/2012 | Saha | A63B 69/0053 482/8 |
| 2015/0360110 | A1* | 12/2015 | Burt, Jr. | A63B 69/32 482/7 |

* cited by examiner

1400

1402

1404

EXERCISE (NAME) SUMARY:

| INTERVAL | PLAYER 1 |
|---|---|
| 1 | .65 / 20 |
| 2 | .78 / 23 |
| ... | ... |
| *N* | FAIL |

DO YOU WANT TO SAVE TO CLOUD? YES NO

1406

EXERCISE (NAME) SUMARY:

| INTERVAL | PLAYER 1 | PLAYER 2 |
|---|---|---|
| 1 | FAIL | .75 / 18 |
| 2 | 1.62 / 21 | FAIL |
| ... | ... | ... |
| *N* | FAIL | FAIL |

DO YOU WANT TO SAVE TO CLOUD? YES NO

*FIG. 14*

METHOD AND APPARATUS FOR A USER-CONFIGURABLE ATHLETIC TRAINING APPARATUS

CROSS REFERENCE

This application claims the benefit of prior U.S. provisional patent application No. 62/038,433 filed Aug. 18, 2014, the entirety of which is hereby incorporated by reference.

BACKGROUND

The present disclosure relates generally to athletic and sports training equipment, and more particularly to interactive and user-configurable apparatus, that cue a trainee to act, time the response of the trainee, and determine the accuracy of the response.

Team sports are widely popular throughout the world, with perhaps the most popular sport being soccer, or football/futbol as it is referred to in other countries. Although team sports require team participation, individual performance is also important for players to contribute to team efforts. In a conventional training regimen players typically train together, performing both team and individual drills that focus on various skills used in the sport. However, without equipment to aid in training, the types of drills and skill techniques that can be practiced by an individual are limited.

Conventional training equipment tends to operate in a manner that results in very repetitive and limited, often by design to force a person to focus on a particular movement or skill. In team sports the conditions during a game or match can be very dynamic, and require the ability of the players to adjust to the conditions, and adjust their technique, as well as make quick judgments about how to best proceed. This type of skill is not well trained by conventional training apparatus that focus on a particular technique, and very often the only way a player can practice under those kinds of conditions is to actually participate in a live team activity.

Accordingly, there is a need for a method and apparatus for a modular, scalable system that allows a user to configure interaction parameters such as cue time, randomness, duration, data collection of the results to allow a single player to practice the kinds of skills need for applying more basic skills during a live, dynamic sporting event without actually having a team of players.

BRIEF DESCRIPTION OF THE FIGURES

In the accompanying figures like reference numerals refer to identical or functionally similar elements throughout the separate views, together with the detailed description below, and are incorporated in and form part of the specification to further illustrate embodiments of concepts that include the claimed invention and explain various principles and advantages of those embodiments.

FIG. 14 shows an interface that displays results of a training regimen of a configurable panel-based athletic training system in accordance with some embodiments;

Figure 1:
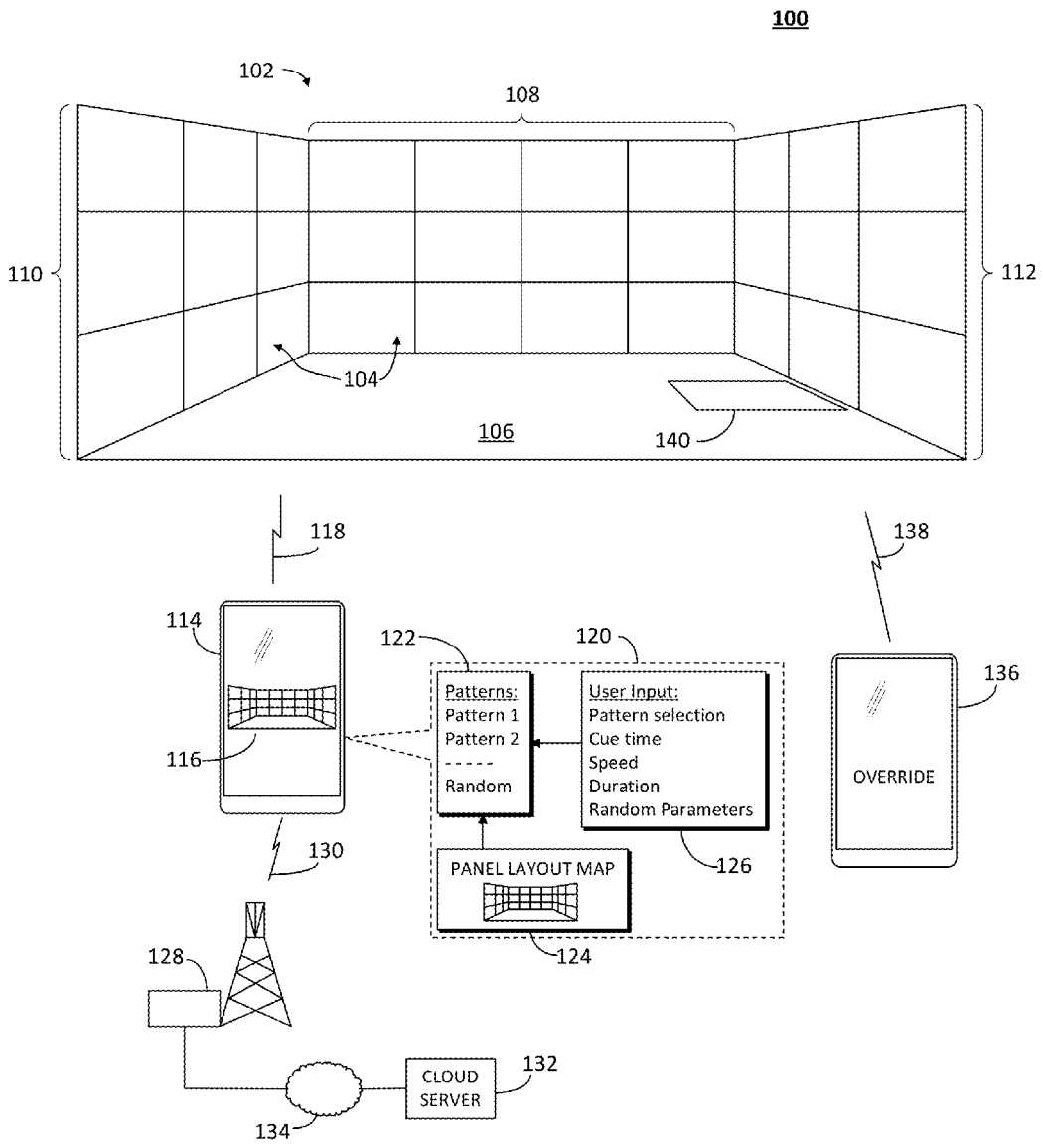
FIG. 1 is a system diagram of a configurable panel-based athletic training system in accordance with some embodiments.

Those skilled in the field of the present disclosure will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein. The details of well-known elements, structure, or processes that would be necessary to practice the embodiments, and that would be well known to those of skill in the art, are not necessarily shown and should be assumed to be present unless otherwise indicated.

DETAILED DESCRIPTION

Embodiments described herein include some embodiments related to a user configurable athletic training system that includes one or more panels that each includes at least one pressure sensor that senses pressure at a front surface of the panel. Each panel further includes at least one illumination source device that selectively illuminates a region of the front surface, and an illumination driver that controls the at least one illumination source device. Each panel further includes a wireless local area network transceiver that communicates using a wireless local area network protocol. The system further includes a control device that communicates with panel or panels via the wireless local area network protocol, and which executes an application that controls timing of illumination of the panel or panels according to a selected regimen. Upon a panel being illuminated and sensing a pressure at the front surface, the illumination is turned off and the panel informs the control device of the pressure input.

FIG. 1 is a system diagram of a configurable panel-based athletic training system 100 in accordance with some embodiments. The system 100 includes an arrangement of one or more panels 102. Each panel is separately controllable, and includes an illumination source and a pressure sensor that detects pressure anywhere on its front surface (e.g. surfaces 104). The illumination source lights up the panel when on, and is turned on or off according to a training regimen. In general, when a panel is illuminated, it actively senses pressure at its front surface, and turns off the illumination upon sensing pressure at the front surface, upon being commanded to turn off the illumination, or upon expiration of an internal default timer. The panels 102 can be arranged in a grid including a front wall 108, a left wall 110, and a right wall 112. Each of the walls comprises three horizontal rows of panels that are placed adjacent each other. There may be some gap between the panels 102 in the grid, and in some embodiments the panels may be spaced apart from each other. The walls 108-112 surround a floor 106 on three sides. The floor is where a player or trainee stands or is otherwise located in order to engage the panels 102. In some embodiments one or more floor panels 140 can be provided on a floor or ground surface of the exercise area. The floor mounted panel 140 can be used, for example, as a starting or ending point of the player, sensing the pressure of the player's weight. In general, the panels 102 are selectively illuminated, and upon being illuminated, the person using the system 100 attempts to impart force (i.e. pressure) on the front surface of the illuminated panel or panels, such as by kicking, throwing, or hitting a ball at the illuminated panel or panels. Once hit, the illuminated panel turns off (i.e. no longer illuminated), and another panel is then illuminated for the player to hit. Although a grid including three walls having three rows of panels is shown here, even a single panel can be used by simply varying the time between when its illumination is turned off and then turned back on. Furthermore, the panels can be fabricated in different shapes, and are not required to be rectangular.

The panels 102 can be controlled by a control device 114 which can be a mobile device such as a smart phone, a tablet computing device, a laptop computer, and so on. The control device 114 can include a graphical display for displaying information, such as a representation 116 of the panels 102. The control device 114 includes a wireless transceiver for communicating via a local wireless network channel 118 with each of the panels 102. The control device 114 runs an application 120 or similar program code that includes one or more patterns 122, which represent different types of training regimens, and can include a random function so that training exercises are varied. The control device 114 also includes a panel layout map 124, which is a map of the layout of the panels 102. The map correlates relative locations of the panels (i.e. relative to each other) with each panel's unique address. The panel layout map 124 can be entered manually by a user of the control device 114, or the control device 114 can interrogate and discover panels 102 wirelessly. The user of the control device 114 can also enter information 126 such as a pattern or regimen selection, a cue time for waiting before initiating a training exercise, a speed parameter difficulty level, a duration parameter for the overall duration of the training exercise, and other parameters such for randomizing the training exercise.

The control device 114 can be connected to a wide area network, such as by a cellular telephony data channel 130 to a terrestrial radio network 128, which can be further connected to a wide area network 134 such as the internet. A cloud server 132 connected to the network 134 can be used to store data produced by the control device 114 relating to the results of the training exercises. Information can be stored by user name so that a user or coach can track their performance over time. A coach or supervisor device 136 can access the cloud server 132 to view results for various players logged by control devices such as control device 114. Furthermore, the coach device 136 can, in some embodiments, override the user settings 126 for a given training exercise via a local wireless network channel 138. The override can be used, for example, when a coach decides that the parameters of the training exercise presently commencing is too difficult, or too easy, for the player using the system 100.

Figure 2:
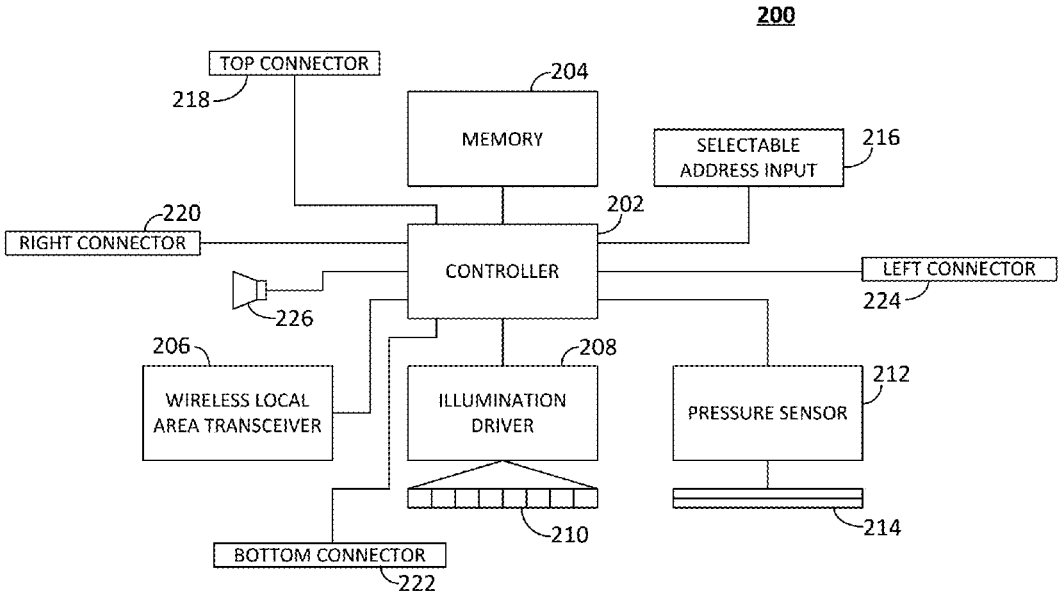
FIG. 2 is a block schematic diagram of an illuminating pressure sensing panel for a configurable panel-based athletic training system in accordance with some embodiments.

FIG. 2 is a block schematic diagram of an illuminating pressure sensing panel 200 for a configurable panel-based athletic training system in accordance with some embodiments. The panel 200 includes a controller 202, such as a microcontroller or microprocessor, which is connected to memory 204. The memory 204 can represent an aggregate of different types of memory, including long term storage memory for executable instruction code and default data, and "scratchpad" memory for instantiating instruction for execution by the controller 202, as well as variable storage. Accordingly, memory 204 can include read only memory (ROM), random access memory (RAM), programmable memory such as flash memory, and so on. The controller 202 is coupled to a wireless local area network transceiver 206 that can transmit and receive radio signal in accordance with a local wireless network protocol. For example, protocols such as those specified by the Institute of Electrical and Electronic Engineers (IEEE) in specifications 802.11 (commonly referred to as "WiFi") and 802.15 (which includes the protocol known as "Bluetooth"), among other known wireless local area network protocols. The wireless local area network transceiver 206 includes a unique network address such as a media access control (MAC) address, as is commonly used.

The panel 200 further includes an illumination source comprised of a driver circuit 208 and illumination output devices 210, such as light emitting diodes (LED). The illumination output devices can light up substantially the entire front surface of the panel by being located behind a translucent or diffusing front surface member that is substantially rigid to allow balls to bounce off the surface much as it would a wall. In some embodiments the illumination output devices 210 can form characters such numeral or alphabetic characters. Furthermore the illumination output devices 210 can produce multiple colors, where different colors can mean different things, such as the panel being a target, or the panel being prohibited (i.e. do not hit). The illumination is controlled by the controller 202 by providing control signals to the illumination driver 208.

In order to detect when the panel 200 is struck, a pressure sensor 212 can be coupled to a pressure plate or transducer 214. The pressure transducer 214 can be mounted such that is fixed between a wall behind the panel 200 and the front surface (e.g. the translucent surface member). The pressure transducer 214 can be one or more piezo elements, for example, which are sensed by the pressure sensor 212 for changes in electrical characteristics of the pressure transducer 214. Accordingly, the pressure sensor 212 can detect changes in pressure, such as upon a ball contacting the front surface of the panel, as well as the magnitude of the pressure, which indicates the force of the ball. The pressure sensor 212 can provide information to the controller 202 indicating the occurrence and magnitude of pressure impulses sensed by the pressure sensor at the pressure transducer 214. Upon sensing a sufficient pressure input, the controller can issue an audible alert via a speaker 226, and can provide visual confirmation by, for example, flashing the illumination source 210 briefly.

When multiple panels are used, they can be arranged as shown, for example, in FIG. 1, or in other ordered arrangements. When intended to be used in an ordered arrangement, the control device (e.g. control device 114) controlling the panels must have information about the relative locations of the panels with respect to each other. To facilitate the device (e.g. device 114) generating a layout map of the panels, a selectable address input 216 can be provided which is user configurable. The selectable address input 216 can be, for example, a dual inline package (DIP) switch array including a plurality of switched, where the settings of the switches are set according to a convention to indicate a wall (e.g. left, front, right), a row location and a column location. The selectable address input 216 can be read by the controller 202, and relayed to the device via the wireless local area network transceiver 206. In some embodiments the panels can have connectors at each edge or side, such as a top connector 218, right connector 220, bottom connector 222, and left connector 224. The connectors 218-224 interface with corresponding connectors on adjacent panels, and allow the controller 202 of each panel to determine its location with respect to other panels. For example, a panel on a bottom row would have nothing connected to its bottom connector 222 but would, assuming there is a row of panels above it, sense a connection at its top connector 218, which would be connected to the bottom connector of the adjacent panel above it. The connections made by the connectors allow the panels to determine their location in an arrangement of panels. The connectors can be, for example, configured as universal serial bus (USB) connectors, allowing the panels to communication with each other through the connectors.

In some embodiments, instead of using a wireless local area transceiver, the control device can be connected to the panels by an addressable bus, such as a USB bus, and the panels can likewise be interconnected connected by such a bus. The locations of the panels can be determined by their connection points; a panel with no connections on its bottom connector can assume it is, for example, on a first row as there are no panels below it. If the panel detects another panel connected to its top connector, it can assume that there is at least one row above it, and the panel connected to the top connector can report to the panel below it whether there is another panel connected on top of it, and so on, allowing the panels to determine their arrangement. These mappings can be reported to a control device in order to allow the control device to contract a layout map of panels for implementing various training regimens.

Figure 3:
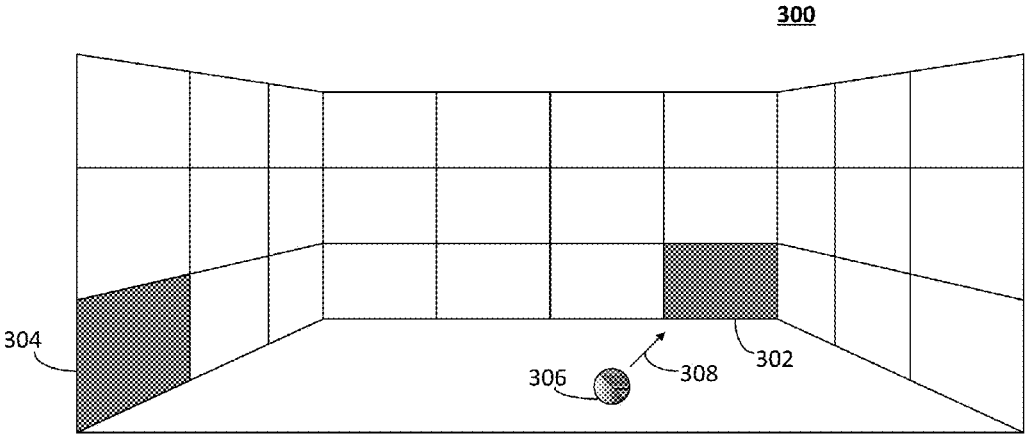
FIGS. 3-5 show a first exemplary training regimen in a configurable panel-based athletic training system in accordance with some embodiments.
Figure 4:
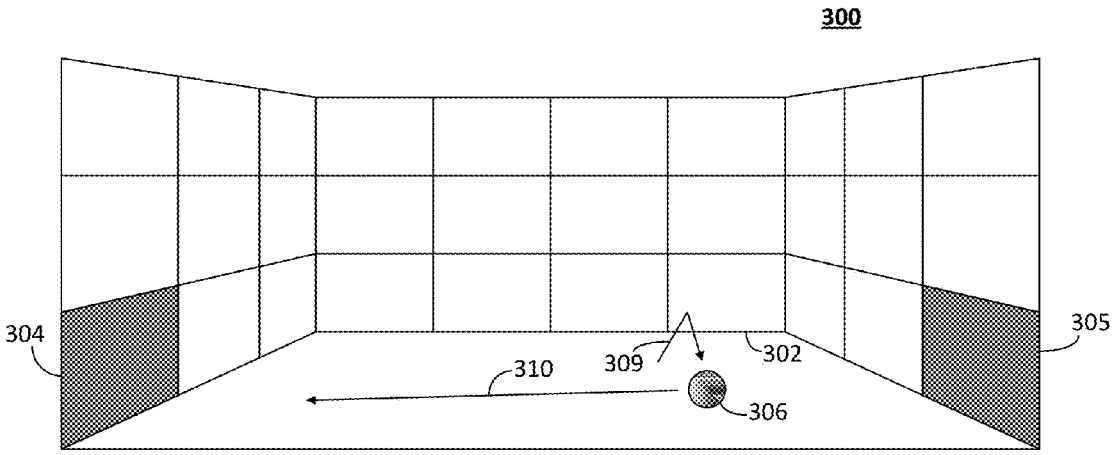
Figure 5:
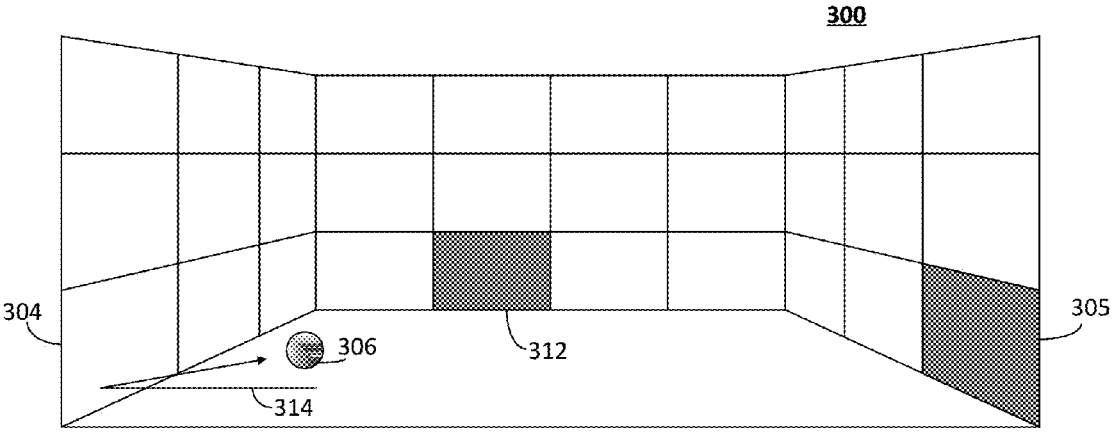

FIGS. 3-5 show a first exemplary training regimen 300 in a configurable panel-based athletic training system in accordance with some embodiments. The exemplary training regimens illustrated herein show the operation of an athletic training system such as that shown in FIG. 1, including a plurality of illuminating pressure sensing, wireless network connected panels. In each training regimen one or more panels are illuminated, meaning the panel's controller causes its illumination source to turn on and emit visible light. When the panel receives an impact, such as upon being hit with a ball, the impact is detected by a pressure sensing system, the illumination is turned off, or changed, to indicate detection of the impact. Thereafter, another panel, or the same panel, can illuminate, as controlled by the control device (e.g. control device 114) that is in communication with the panel or panels.

Accordingly, in regimen 300 a player or trainee uses a ball 306 in a training area similar to that shown in FIG. 1. Upon commencement of the regimen 300, as shown in FIG. 3, panels 302 and 304 illuminate in response to a commend from the control device (not shown). In this exemplary training regimen two panels are always illuminated, and each illuminated panel is a valid target. The player then attempts to direct the ball 306 to impact one of the illuminated panels 302, 304. Specifically, in FIG. 3, the player has chosen to direct (e.g. kick) the ball 306 to impact panel 302 as indicated by line 308. In FIG. 4 line 309 indicates that the ball 306 has impacted and rebounded off panel 302, which is therefore no longer illuminated having sensed the impact. However, panel 304 remains illuminated, and panel 305 becomes illuminated as another potential target, so the player directs the ball to panel 304 as indicated by line 310. In FIG. 5 the ball 306 has rebounded off panel 304, which as a result is no longer illuminated, as indicated by line 314. To continue the regimen, panel 312 is then turned on (i.e. illuminated), leaving panels 305, 312 illuminated as valid targets. The illumination of the panels can be indefinite, i.e. until hit or the regimen is over, or they can be timed such that if no panel is hit within a specified time interval after being illuminated the interval is scored as a failure. Note than in this exemplary training regimen 300 only panels at the floor level are used, which can train skills required for passing a ball to other players in soccer, for example.

Figure 6:
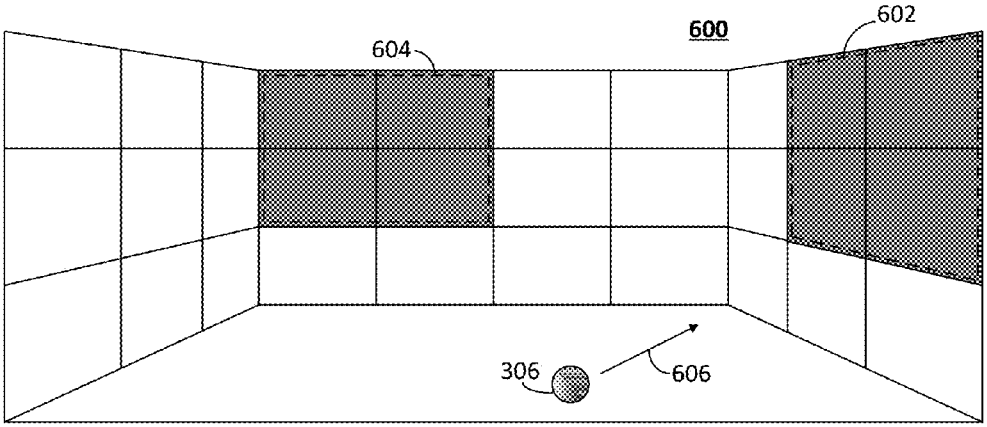
FIGS. 6-7 show a second exemplary training regimen in a configurable panel-based athletic training system in accordance with some embodiments.
Figure 7:
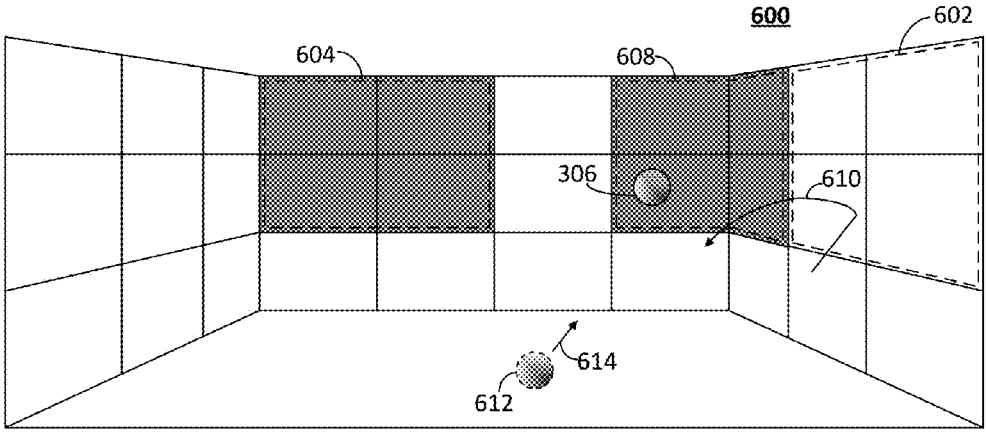

FIGS. 6-7 show a second exemplary training regimen 600 in a configurable panel-based athletic training system in accordance with some embodiments. Regimen 600 illustrates how panels can be grouped together to form a target. Groups 602 and 604 each consist of four panels that are all illuminated as part of the group, and hitting any one of the panels in groups 602, 604 with the ball 306 turns off the entire group (i.e. each panel turns off its own illumination). Furthermore, groups 602, 604 do not include any panels at the floor level, which requires the player to get the ball 306 airborne. In FIG. 6 the player has chosen group 602, and kicks the ball 306 upwards towards group 602, as indicated by line 606. In FIG. 7, after hitting one of the panels in group 602, causing the panels in group 602 to each turn off their illumination, the ball rebounds as indicated by line 610, and can fall back to position 612. In response to group 602 turning off, a new group of panels, group 608, becomes illuminated in a corner of the area. The panels in group 604 remain illuminated. For a second target to hit, the player can chose group 608, as indicated by line 614, causing the ball 306 to impact a panel in group 608. As in the first regimen 300, the process can continue until some end criteria is reached or the user simply ends the exercise. Every time one panel in a group is impacted, the panels in the group are all collectively turned off (i.e. illumination source is powered off), and the controlling device (i.e. device 114) selects another group, or the same group, to be illuminated as another valid target.

Figure 8:
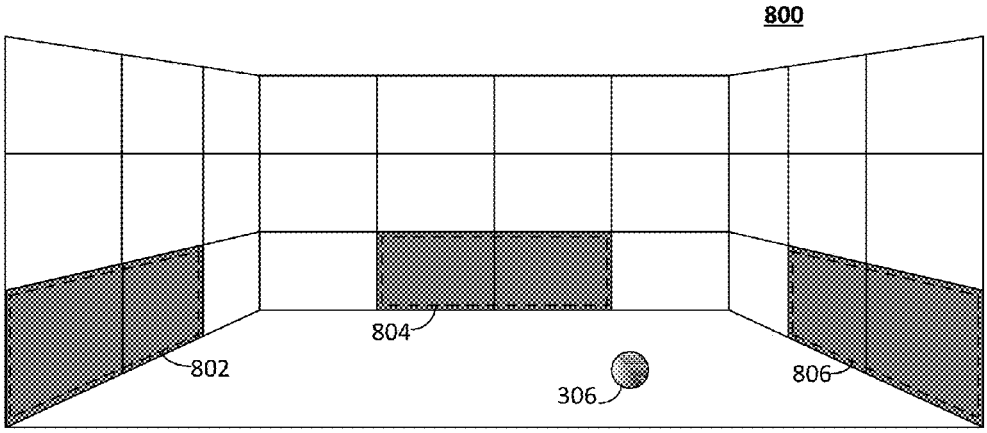
FIGS. 8-10 show a third exemplary training regimen in a configurable panel-based athletic training system in accordance with some embodiments.
Figure 9:
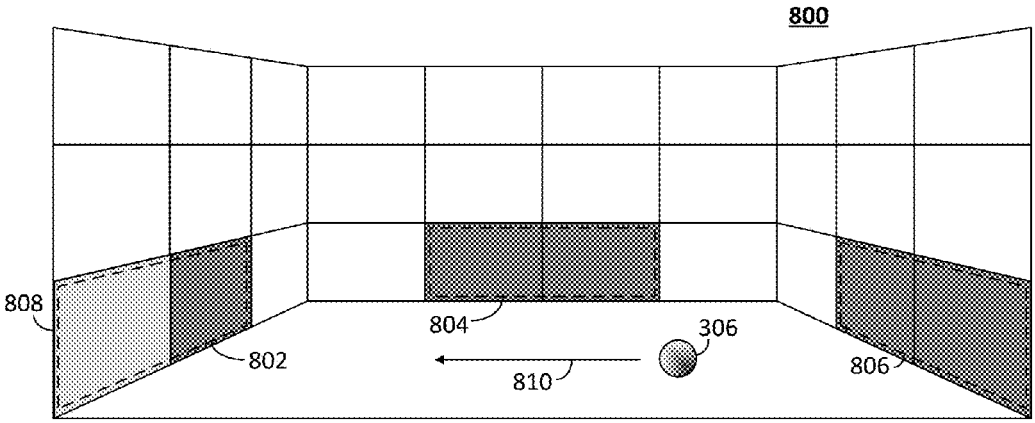
Figure 10:
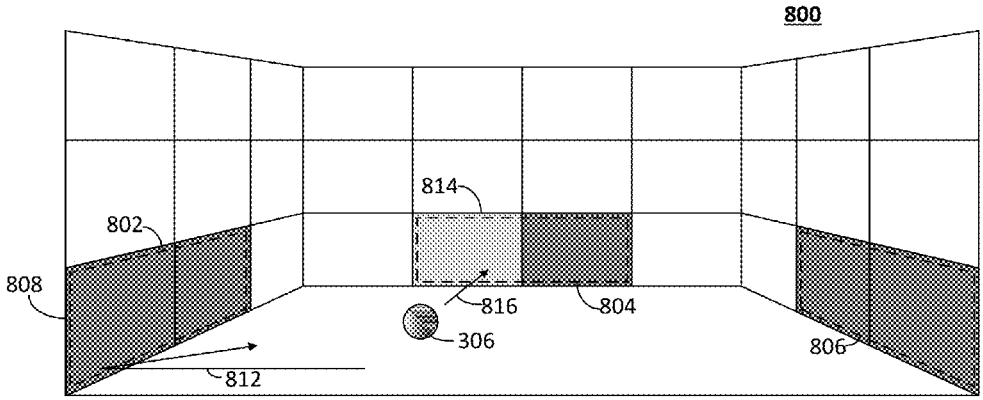

FIGS. 8-10 show a third exemplary training regimen 800 in a configurable panel-based athletic training system in accordance with some embodiments. Regimen 800 utilizes multiple colors of illumination where one color represents a valid target, and another color represents a prohibited target. Non-illuminated panels are neutral, and are neither valid nor prohibited targets (as in the previously discussed regimens). In FIG. 8 the regimen 800 is commenced by illuminating three groups of panels 802, 804, 806 completely in the prohibited color. That is, each panel in groups 802-806 is controlled to illuminate in the prohibited target color. After a random initial cue time, in FIG. 9 the regimen commences by changing the color of one panel in one of the groups. Specifically, panel 808 of group 802 is changed from the prohibited color to the valid color. The player must cause an impact on panel 808, without hitting any panel illuminated in the prohibited color. Accordingly, the player can, for example, kick ball 306 towards panel 808 as indicated by arrow 810. If panel 808 is struck, a success is scored for the interval, but if the other panel in group 802 is instead struck, then a failure is logged for the interval. Assuming success in hitting panel 808, the regimen continues in FIG. 10 were panel 814 of group 804 is changed from the prohibited color to the valid color. Accordingly, the player then kicks the ball 306 at panel 814 for the next interval. The regimen 800 can continue like this where a success or failure is scored for each interval, an interval being the time during which the panels are illuminated in a particular pattern unit either a success or failure occurs, or a preselected time period elapse without either a success or failure.

Figure 11:
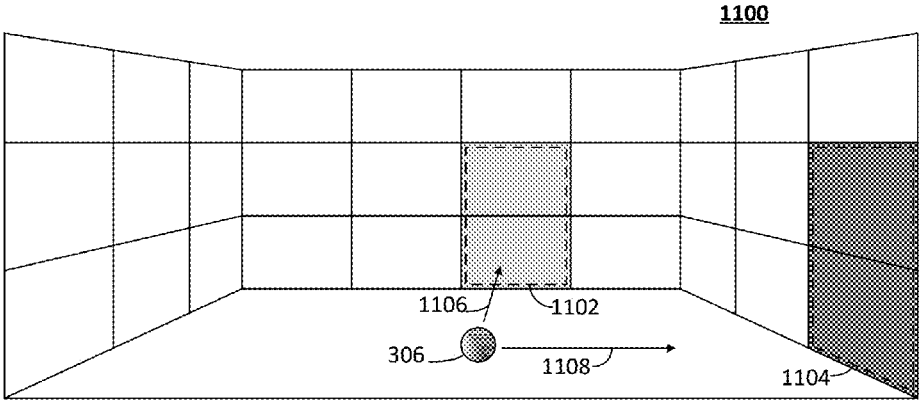
FIG. 11 shows a fourth exemplary training regimen for a multi-player scenario in a configurable panel-based athletic training system in accordance with some embodiments.

FIG. 11 shows a fourth exemplary training regimen 1100 for a multi-player scenario in a configurable panel-based athletic training system in accordance with some embodiments. Regimen 1100 illustrates the use of multicolor illumination for multiple players. Accordingly, a first color can be designated for a first player while a second color can be designated for a second player. An impact on a panel illuminated with the first color is scored as a success for the first player, while an impact on a panel illuminated with the second color is scored as a success for the second player. In the particular example of FIG. 11, a first group of panels 1102 is illuminated with the first color, while a second group of panels 1104 is illuminated with the second color. A first player then wants to kick the ball 306 into the first group 1102, while a second player attempts, at the same time, to take control of the ball and kick it into impact with one of the panels of the second group 1104, as indicated, respectively, by lines 1106, 1108. When a player scores success, another group of panels can be illuminated with the color corresponding to that player, and the regimen 1100 can continue on as such.

Figure 12:
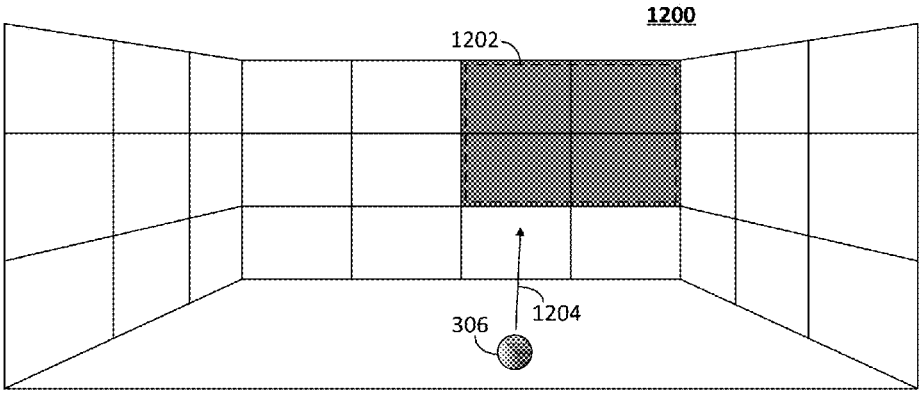
FIG. 12 shows a fifth exemplary training regimen in a configurable panel-based athletic training system in accordance with some embodiments.

FIG. 12 shows a fifth exemplary training regimen in a configurable panel-based athletic training system in accordance with some embodiments. Regimen 1200 illustrates a single player regimen where only a single panel or group of panels 1202 is illuminated at a time. Thus regimen 1200 can be an example of an exercise designed to develop strength and power in the player's technique, rather than a skill that emphasizes timing and handling as exemplified in other regimens discussed. In particular, a goal of regimen 1200 can be for the player to cause the ball 306 to hit the valid target, one of the panels in group 1202, with a minimum force. The pressure sensing subsystem of each panel can measure the degree of pressure caused by the impact. If an impact is received that exceeds the minimum pressure, then a success is logged for the interval. An impact that results in a pressure lower than the minimum can either be ignored or scored a failure. Once a success, or a failure, occurs, the group 1202 can be turned off, and other group can be illuminated. It will be appreciated that groups can be of different sizes, from a single panel to several panels or even all panels. Systems using fewer panels will have fewer options, of course, but the regimen 1200 can be commenced even with a single panel.

Figure 13:
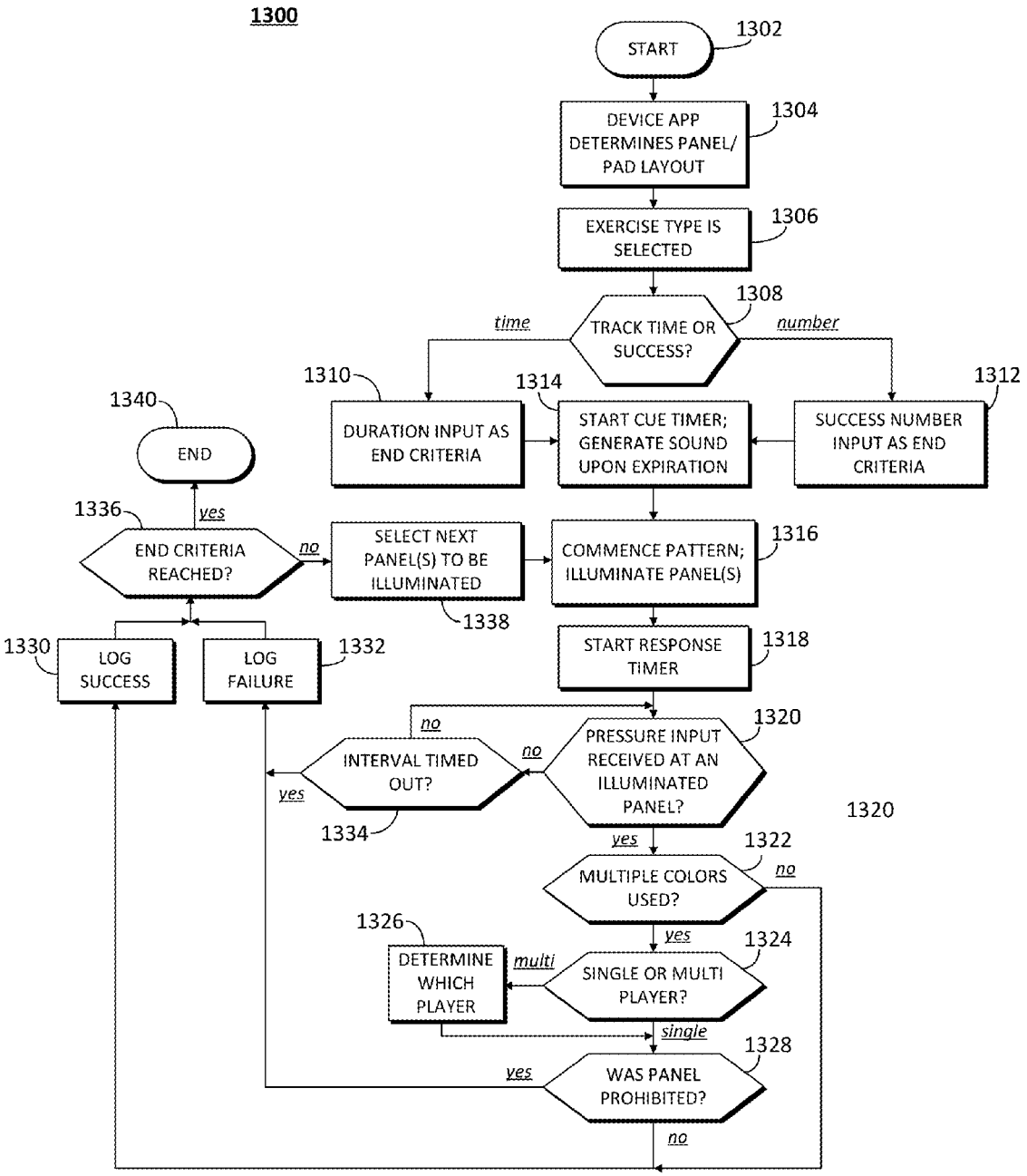
FIG. 13 is a flow chart diagram for method of operating a configurable panel-based athletic training system in accordance with some embodiments.

FIG. 13 is a flow chart diagram for method 1300 of operating a configurable panel-based athletic training system in accordance with some embodiments. At the start 1302 the system is powered up, meaning both the control device (e.g. control device 114) and the panel or panels are powered and ready for use. A first step 1304 includes the control device determining the panel layout. The control device can, for example, transmit a wireless beacon, causing the panel or panels to respond, giving some indication of their relative location with respect to each other. In some embodiments a grid address convention can be used where a wall, row, and column parameter can be indicated in a panel's address information. Alternatively, the panel or panels can simply respond as being present, and the user of the control device can input information for each discovered panel regarding its relative location.

In step 1306 the user of the control device can select an exercise or regimen to be used. In step 1308 the user can provide an indication of the regimen end criteria, such as a maximum duration of time, or a number of successes. Accordingly, if time is selected, then the method proceeds to step 1310 where the input time value is used as an end of regimen criteria. If in step 1308 a number of successes are indicated as an end of regimen criteria, the method proceeds to step 1312 where the number of successes indicted is input as the end of regimen criteria. In step 1314 the regimen is commenced by a cue timer where a ready sound can be played, or some other "get ready" indication can occur (e.g. blinking a panel's illumination on and off). In step 1316 the regimen is commenced by illuminating one or more panels in one or more groups, depending on the selected regimen. What occurs is that the control device determines which panels are to be illuminated, and sends a signal via the wireless local area network protocol to the selected panel or panels to turn on their illumination, and the color of the illumination in a multicolor regimen. Using the wireless local area network protocol, the panel or panels can acknowledge the command and indicate compliance/success in turning on their illumination. In step 1318 the control device, or each panel, or both, can commence a response timer to measure the time from being illuminated to receiving an impact. If the control device operates the response timer than it depends on receiving an indication of an impact, via the wireless local area network protocol, from an impacted panel in order to stop or otherwise note the response timer value.

In step 1320 the method 1300 determines whether a pressure input, i.e. an impact, is received at one of the illuminated panels. A non-illuminated panel will ignore impacts. Upon being struck or otherwise receiving an impact, an illuminated panel transmits an impact message to the control device via the wireless local area network protocol. The method 1300 loops between steps 1320 and 1334 while no impact is detected. Step 1334 determines whether an interval timer has expired, meaning that the maximum time for the player to hit an illuminated panel has expired. If no maximum interval time is selected then step 1334 can be skipped, and step 1320 simply keeps repeating. Upon an impact being detected, the method 1300 proceeds to step 1322 where it is determined if multiple colors are being used. If the regimen is not a multicolor regimen, then the method proceeds to step 1330 and a success is logged. If the regimen is a multicolor regimen, then it is determined whether it is a single or multiplayer regimen in step 1324. If it is a multiplayer regimen, then the method proceeds to step 1326 where the color impacted is determined. In step 1328 the method 1300 determines whether the impacted color is a prohibited color or not. In a multiplayer regimen, four colors of illumination can be used, where there is a valid and prohibited color for each of two players, for example. If the impacted panel was a prohibited color, then the method proceeds to step 1332 where failure is scored for the corresponding player (or simply the player in a single player regimen). In some embodiments upon the pressure being detected in step 1320, or upon scoring a success or failure in steps 1330, 1332, a panel can provide an audible indication of the success or failure, and/or the panel can flash its illumination to indicate success or failure.

The various exemplary regimens of FIGS. 3-12 show static regimen where a target stays illuminated until at least some panel is impacted. However, it will be appreciated that, in a multi-panel system, panels can be controlled to simulate a moving target. Upon being illuminated, a short interval time is selected, and upon expiration of the interval time the panel is commanded to turn off while an adjacent panel is commanded to turn on. A succession of a series of adjacent panels can be turned on and off such that the illumination simulates movement across a training area. The player must than anticipate which panel will be illuminated upon throwing or kicking the ball 306 such that the panel with which the ball makes contact is illuminated at the time of contact. Furthermore, while discussed with regard to soccer, it will be appreciated that various regimen can be designed or used for different sports, including American football, and other sports. Additionally, while the panels of FIGS. 1 and 3-12 are presented as a grid, where each panel is abutting adjacent panels, it will be appreciated that panels can be spaced apart, and even facing in different directions. Thus, a similar benefit can be had without necessarily have a wall covered with panels.

Once either step 1330 or step 1332 is performed, a present interval is concluded, and the method can commence to step 1336 where it is determined whether the end criteria (e.g. conditions indicated in either step 1310 or 1312) have been met. If so, then the method 1300 ends 1340. If not, then another interval can be commenced by proceeding to step 1338 where the control device selects the next panel or panels to be illuminated, or if a single panel is used, a backoff time period can be selected before the panel is illuminated. The method then commences to step 1316 and another interval is commenced by repeating a portion of the method (e.g. steps 1318-1336). The results of the regimen can, in step 1340, be uploaded to a server for storage and perusal by others, such as a coach or other supervisory entity.

FIG. 14 shows an interface 1400 that displays results of a training regimen of a configurable panel-based athletic training system in accordance with some embodiments. The display 1400 can be presented, for example, on a graphical display 1402 of a control device, or some other device accessing a record of a player of players' results. A first portion or record 1404 shows, as an example, the exercise or regimen name, the various intervals, and a response time and pressure level for the response. So, for interval 1 of the regimen in record 1404, the player had a response time of "0.65" seconds, and an impact pressure of "20" lbs. The record 1404 can include N intervals, and in the Nth interval there is a failure indicated. An option to save the results can be presented (i.e. "do you want to save to cloud") with hyperlinks for "yes" and "no," respectively. If "yes" is selected then the information of record 1404 can be uploaded to a server for storage. If "no" is selected then no action is taken and the user can proceed to another display to commence another regimen, or exit the application on the control device. In record 1406 the results of a two player regimen are shown in accordance with some embodiments. For each interval, when one player succeeds the response time and pressure are shown for the succeeding player, and a fail is scored for the other player. Similarly, in some regimens, both players can fail if no player manages to strike their respective panels, and an option to upload the results can be provided.

Figure 15:
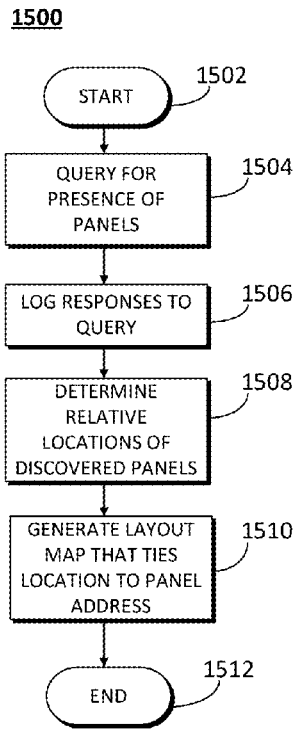
FIG. 15 shows a flow chart diagram of a method of setting up a configurable panel-based athletic training system in accordance with some embodiments.

FIG. 15 shows a flow chart diagram of a method 1500 of setting up a configurable panel-based athletic training system in accordance with some embodiments. At the start 1502, the control device and panels are powered on. In step 1504 the control device transmits a beacon or query, requesting the panel or panels respond. The query is transmitted, for example, via a wireless local area network protocol. Each panel that receives the query can respond. The responses can be conducted using a media access protocol to avoid the panels "talking over" each other. In step 1506 the control device logs the responses from the panel or panels. The responses each indicate a relative location, if there are multiple panels. For example, the responses can use an addressing convention such as indicating a wall, a row, and a column in a grid pattern, or another addressing convention. In step 1508 the control device determines the relative location of each discovered panel, and in step 1510 the control device generates a layout map that correlates location with an identifier of the panel such as a MAC address. Once the layout map is generated the method ends 1512 and an exercise regimen can then be selected and commenced using the layout map to control the various panels.

Figure 16:
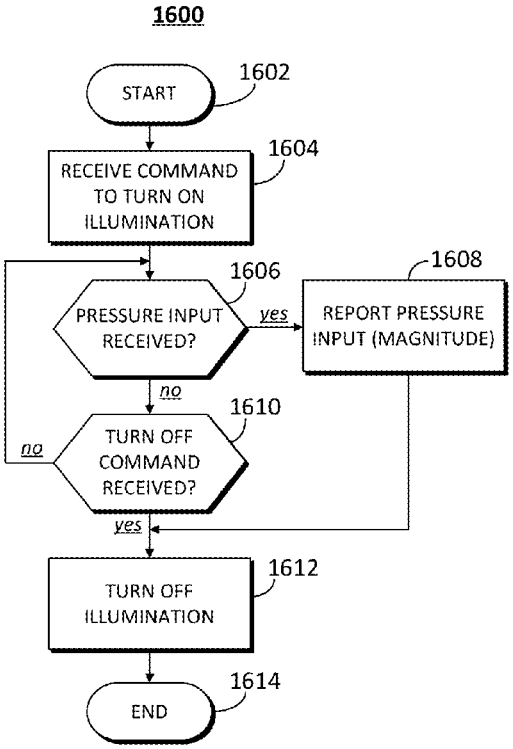
FIG. 16 shows a flow chart diagram of a method of operating an illuminating pressure sensing panel in accordance with some embodiments.

FIG. 16 shows a flow chart diagram of a method 1600 of operating an illuminating pressure sensing panel in accordance with some embodiments. At the start 1602 the panel is powered on, and its location with respect to other panels, if any, has been determined by the control device. During the course of an exercise regimen, the panel may be commanded to turn on, meaning to turn on its illumination source device, as in step 1604. Until and unless such a command is received, the panel remains neutral and not illuminated. The command can be received via a wireless local area network protocol message addressing the panel specifically, either as an individual or as part of a group of panels, and it can also indicate a color of illumination. Upon being commanded to turn on its illumination, the panel then turns on its illumination source to the indicated color, if any, and monitors its pressure sensor in step 1606. While no pressure input is received, the method can also monitor for a turn off command message in step 1610. The panel remains illuminated while no pressure input and no turn off command are received. If a pressure input is received, i.e. the panel is struck at its front surface, then in step 1608 the panel can report the pressure input and magnitude of the pressure in a message to the control device sent via the wireless local area network protocol. Furthermore, after detecting the pressure input, the panel can turn off its illumination in step 1612. Likewise, if no pressure input is received, and the panel receives a turn off command in step 1610, the panel can commence to step 1612 and turn off its illumination. A turn off command can also be received if a different panel in a group to which the illuminated panel belongs reports an impact. Once the illumination is turned off the method then ends 1614 for the present interval of the regimen. The panel exemplified in method 1600 can perform method 1600 again in a subsequent interval of the same regimen.

Figure 17:
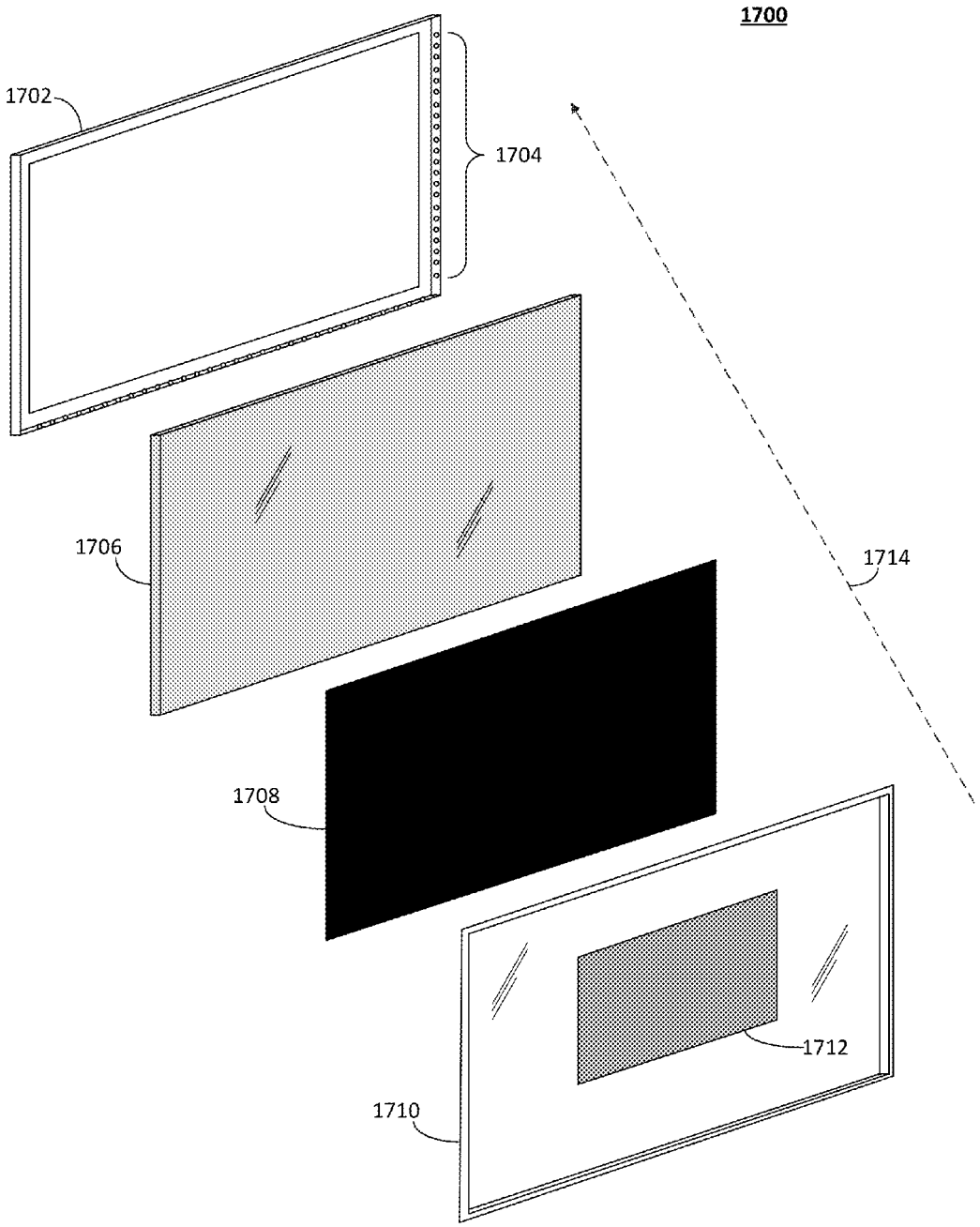
FIG. 17 shows a rear isometric exploded view of an illuminating pressure sensing panel in accordance with some embodiments.

FIG. 17 shows a rear isometric exploded view of an illuminating pressure sensing panel 1700 in accordance with some embodiments. The panel 1700 construction illustrated here can be the same as that used for panels shown in FIGS. 1, 3-12, and 18-21 herein. The panel can include an outer frame member 1702 which has inner edges in which a plurality of illumination sources such as LEDs 1704 can be mounted. The LEDs 1704 can be mounted on all four inner edges, and are arranged on the inner edges to shine inward, relative to the inner edge on which they are mounted. The LEDs 1704 can include LEDs of different colors in order to produce different colors of light. A translucent front surface member 1706 can be mounted in the outer frame member, and sized such that light from the LEDs 1704 shine into the translucent material of the translucent front member 1706. Being translucent, the light from the LEDs 1704 is diffused throughout the translucent front surface member 1706 such that when the LEDs are turned on, the translucent front surface member 1706 appears to light up with the color produced by the LEDs 1704 when viewed from the front of the panel. The translucent front surface member can have a textured front surface (facing away, as shown in this view), and is made of a flexible material such as a polymeric material. One or more pressure plates 1708 are mounted behind, and in contact with the translucent front surface member 1706. A front of the pressure plate can be painted or treated to reflect light to optimize the illumination of the translucent front surface member 1706 by the LEDs 1704. Upon a ball striking the front surface of the translucent front surface member 1706, the impact will impart force through the translucent front surface member 1706 an into the pressure plate 1708, causing a change of electrical characteristics of the pressure plate 1708, which can be detected by a pressure sensing circuit (e.g. circuit 212). To support the pressure plate 1708, an inner frame member 1710 provides rigid support and backing for the pressure plate 1708 and translucent front surface member 1706, as well as capturing these components in the external frame member 1704, such as by screws or bolts that attach the inner frame member 1710 to the outer frame member 1702, and the components 1702, 1706, 1708, and 1710 are assembled in the direction of line 1714. A circuit board 1712 can be mounted behind the inner frame member 1710 to support the circuitry that operates and powers the panel 1700, and which controls the LEDs 1704 and interfaces with the pressure plate(s) 1708 to sense pressure.

Figure 18:
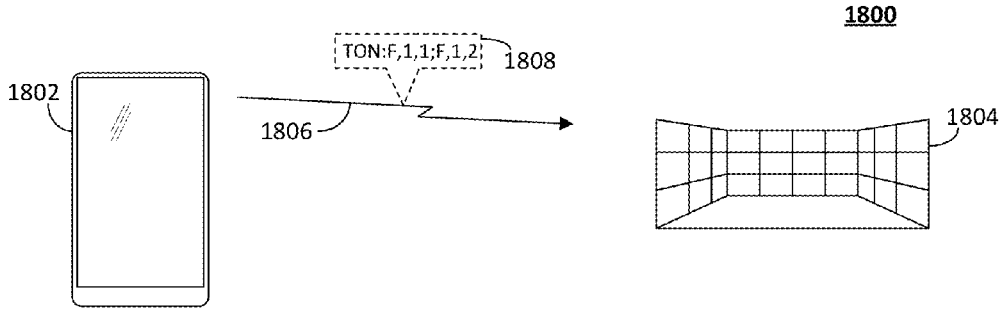
FIGS. 18-21 show a sequence of messaging between a control device and several illuminating pressure sensing panels during an exercise regimen, in accordance with some embodiments.
Figure 19:
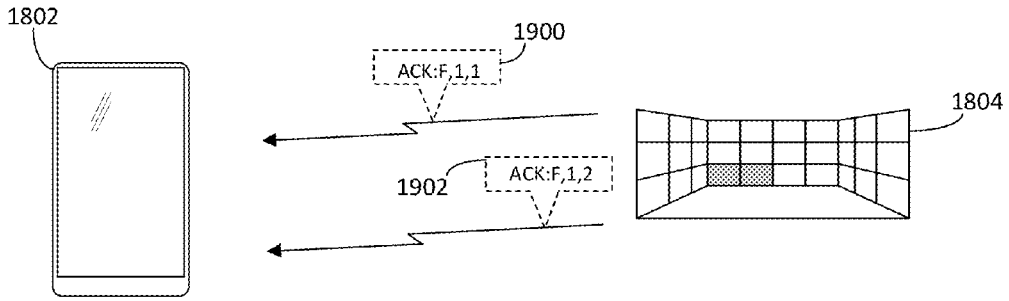
Figure 20:
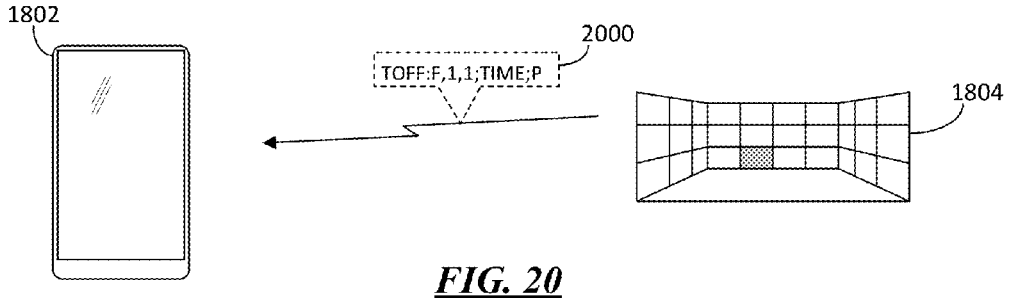
Figure 21:
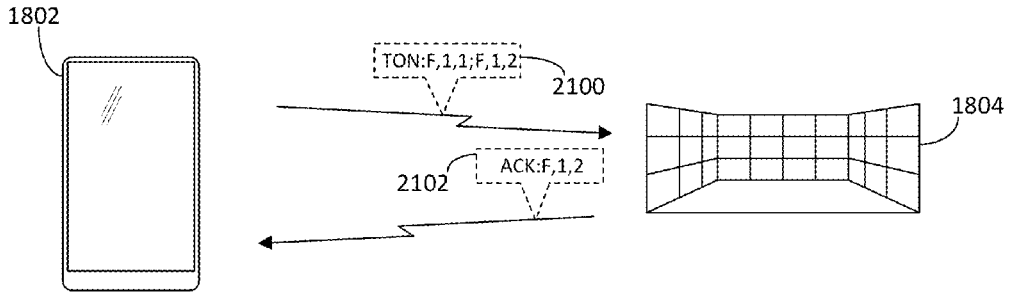

FIGS. 18-21 show a sequence 1800 of messaging between a control device 1802 and several illuminating pressure sensing panels 1804 during an exercise regimen, in accordance with some embodiments. In FIG. 18 the panels 1804 are set up and ready for operation, and the control device 1802 has acquired a layout map of the panels 1804. To commence the regimen, the control device messages one or more panels with a command to turn by transmitting a signal 1806 that conforms to a wireless local area network protocol. The signal 1806 contains a message 1808 including a turn on command ("TON"), and which identifies the panels subject to the command, which in this example includes a panel on the front wall, first row, and first column ("F,1,1"), and another panel on the front wall, first row, second column ("F,1,2"). In FIG. 19 the two panels are then illuminated, and each responds with an acknowledgement message ("ACK") and their address or location (e.g. "F,1,1") so that the control device knows the panels have received and complied with the command. In FIG. 20 one panel has received an impact, and as a result has turned off. To indicate such, the panel transmits a message 2000 to the control device 1802 indicated it has turned off ("TOFF") along with its identifier, and can also include a time parameter ("TIME") indicating the time between turning its illumination and sensing the impact, and a pressure parameter ("P") indicating the magnitude of the sensed pressure. FIG. 21 shows an example of the expiration of an interval without any further impacts on illuminated panels occurring. The control device 1802, upon determining that the interval time has elapsed, transmits a message 2100 commanding the remaining panel to turn off. In response, the panel turns off its illumination and responds with an acknowledgement message 2102.

The embodiments disclosed herein provide the benefit of a structured athletic exercise system that allows users to develop skills in a dynamic manner simulating team play, but without requiring multiple people to create a team play environment. Furthermore, the disclosed system and components allows users to develop exercise regimens to drill particular skills in a dynamic manner in a way that cannot be achieved with a static apparatus. They system is customizable in size and configuration, and the exercise regimens can be adapted to the number of panels present, from one panel to a system where several walls are covered in a matrix or grid of panels. The system also allows users to save results in a network connected storage system that can be accessed by others, such as coaches, trainers, or other supervisors (or friends or other social contacts).

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

It will be appreciated that some embodiments may be comprised of one or more generic or specialized processors (or "processing devices") such as microprocessors, digital signal processors, customized processors and field programmable gate arrays (FPGAs) and unique stored program instructions (including both software and firmware) that control the one or more processors to implement, in conjunction with certain non-processor circuits, some, most, or all of the functions of the method and/or apparatus described herein. Alternatively, some or all functions could be implemented by a state machine that has no stored program instructions, or in one or more application specific integrated circuits (ASICs), in which each function or some combinations of certain of the functions are implemented as custom logic. Of course, a combination of the two approaches could be used.

Moreover, an embodiment can be implemented as a computer-readable storage medium having computer readable code stored thereon for programming a computer (e.g., comprising a processor) to perform a method as described and claimed herein. Examples of such computer-readable storage mediums include, but are not limited to, a hard disk, a CD-ROM, an optical storage device, a magnetic storage device, a ROM (Read Only Memory), a PROM (Programmable Read Only Memory), an EPROM (Erasable Programmable Read Only Memory), an EEPROM (Electrically Erasable Programmable Read Only Memory) and a Flash memory. Further, it is expected that one of ordinary skill, notwithstanding possibly significant effort and many design choices motivated by, for example, available time, current technology, and economic considerations, when guided by the concepts and principles disclosed herein will be readily capable of generating such software instructions and programs and ICs with minimal experimentation.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description as part of the original disclosure, and remain so even if cancelled from the claims during prosecution of the application, with each claim standing on its own as a separately claimed subject matter. Furthermore, subject matter not shown should not be assumed to be necessarily present, and that in some instances it may become necessary to define the claims by use of negative limitations, which are supported herein by merely not showing the subject matter disclaimed in such negative limitations.

I claim:

1. A user configurable athletic training system, comprising:

at least one panel comprising:

an outer frame member;

a translucent front surface member mounted in the outer frame member;

a plurality of light emitting diodes that controllably illuminate the translucent front surface member that are mounted on an inner edge of the outer frame member;

at least one pressure sensor, in contact with a back surface of the translucent front surface member, and that senses pressure applied to a front surface of the translucent front surface member;

an inner frame member that holds the at least one pressure sensor and translucent front surface member together in the at least one panel and which supports the at least one pressure sensor;

at least one illumination source device that selectively illuminates a region of the translucent front surface member;

an illumination driver that controls the at least one illumination source device;

a wireless local area network transceiver that communicates using a wireless local area network protocol; and a control device that communicates with the at least one panel via the wireless local area network protocol, and executes an application that controls timing of illumination of the at least one panel according to a selected regimen, wherein upon the at least one panel being illuminated and sensing a pressure input which exceeds a minimum pressure threshold resulting from an impact at the front surface, the illumination is turned off and the at least one panel informs the control device of the pressure input.

2. The user-configurable athletic training system of claim 1, wherein the at least one panel comprises a plurality of panels; and wherein the panels are controlled by the control device such that different ones of the plurality of panels are illuminated at a time.

3. The user-configurable athletic training system of claim 2, wherein each of the plurality of panels are rectangular and are mounted in a grid formation such that each panel is adjacent at least one other panel.

4. The user-configurable athletic training system of claim 3, wherein the regimen comprises illuminating at least two adjacent panels during an interval of the regimen, and wherein the illumination is turned off upon receiving the pressure input at any of the at least two adjacent illuminated panels.

5. The user-configurable athletic training system of claim 1, wherein the regimen specifies timing information that indicates an interval duration for a maximum period of time the at least one panel is illuminated and does not receive a pressure input.

6. The user-configurable athletic training system of claim 1, wherein an illumination sequence and timing of the regimen are controlled by the control device.

7. The user-configurable athletic training system of claim 1, wherein the at least one panel measures a magnitude of the pressure input and provides the magnitude to the control device upon sensing the pressure input.

8. The user-configurable athletic training system of claim 1, wherein a sequence of panel illumination of the regimen creates a virtual motion.

9. The user-configurable athletic training system of claim 1, wherein the control device provides results of the regimen to a network-connected server.

10. The user-configurable athletic training system of claim 1, wherein the at least one panel includes at least one vertically mounted panel and at least one floor mounted panel.

11. An illuminating pressure sensing panel for use in a user-configurable athletic training system, comprising:

an outer frame member;

a translucent front surface member mounted in the outer frame member;

an illumination source disposed on an inner edge of the outer frame member and configured to emit light through the translucent front surface member;

a pressure sensor including a pressure plate mounted behind the translucent front surface member that is responsive to pressure applied at a front of the translucent front surface member, wherein the pressure sensor and the translucent front surface is configured to withstand and measure impacts caused by a ball, used for an athletic sport, striking the pressure sensing panel as part of training for the athletic sport;

an inner frame member that holds the pressure plate and translucent front surface member in the outer frame member and which provides rigid support for the pressure plate;

a communication circuit; and a controller that controls operation of the illumination source, pressure sensor, and communication circuit, wherein upon the at least one panel sensing a pressure input which exceeds a minimum pressure threshold consistent with detecting an impact of the ball striking the pressure sensing panel, the controller changes an illumination state of the pressure sensing panel;

wherein the illuminating pressure sensing panel communicates with a control device via the communication circuit, and is configured to, upon receiving a command to illuminate, turns on the illumination source and is further configured to turn off the illumination source upon being commanded by the control device to turn off the illumination source, sensing a pressure input at the pressure sensor, or upon expiration of an interval time, and wherein the panel is further configured to communicate an indication of the pressure input upon receiving the pressure input which exceeds the minimum pressure threshold consistent with detecting the impact of the ball striking the pressure sensing panel.

12. The illuminating pressure sensing panel of claim 11 wherein the communication circuit is a wireless local area network communication circuit.

13. The illuminating pressure sensing panel of claim 11, wherein the pressure sensor measures a magnitude of the pressure input and provides the magnitude to a control device upon sensing the pressure input via the communication circuit.

14. A user configurable athletic training system, comprising:

at least one panel comprising:

an outer frame member;

a translucent front surface member mounted in the outer frame member;

a plurality of light emitting diodes that controllably illuminate the translucent front surface member that are mounted on an inner edge of the outer frame member;

at least one pressure sensor, in contact with a back surface of the translucent front surface member, and that senses pressure applied to a front surface of the translucent front surface member;

an inner frame member that holds the at least one pressure sensor and translucent front surface member together in the at least one panel and which supports the at least one pressure sensor;

at least one illumination source device that selectively illuminates a region of the translucent front surface member;

an illumination driver that controls the at least one illumination source device; and a wireless local area network transceiver that communicates with a control device using a wireless local area network protocol, wherein the panel, the at least one pressure sensor, and the at least one illumination source device are configured such that timing of illumination of the region is in accordance with a selected regimen for athletic training, wherein an illumination state of the panel changes responsive to sensing a pressure input which exceeds a minimum pressure threshold for detecting an impact of a ball used in the athletic training striking the front surface.

15. The user-configurable athletic training system of claim 14, wherein the at least one panel comprises a plurality of panels; and wherein the panels are controlled by the control device such that different ones of the plurality of panels are illuminated at a time.

16. The user-configurable athletic training system of claim 15, wherein each of the plurality of panels are rectangular and are mounted in a grid formation such that each panel is adjacent at least one other panel.

17. The user-configurable athletic training system of claim 16, wherein a regimen comprises illuminating at least two adjacent panels during an interval of the regimen, and wherein the illumination is turned off upon receiving the pressure input at any of the at least two adjacent illuminated panels.

18. The user-configurable athletic training system of claim 14, wherein the control device controls the at least one panel according to a regimen that specifies timing information which indicates an interval duration for a maximum period of time the at least one panel is illuminated and does not receive a pressure input.

19. The user-configurable athletic training system of claim 18, wherein an illumination sequence and timing of the regimen are controlled by the control device.

20. The user-configurable athletic training system of claim 14, wherein the at least one pressure sensor measures a magnitude of the pressure input and the at least one panel provides the magnitude to the control device upon sensing the pressure input.

* * * * *